US011172302B2

(12) United States Patent
Sheffield

(10) Patent No.: US 11,172,302 B2
(45) **Date of Patent: *Nov. 9, 2021**

(54) METHODS OF USING HEADPHONES WITH NOISE CANCELLATION OF ACOUSTIC NOISE FROM TACTILE VIBRATION DRIVER

(71) Applicant: Skullcandy, Inc., Park City, UT (US)

(72) Inventor: Branden Sheffield, Saratoga Springs, UT (US)

(73) Assignee: Skullcandy, Inc., Park City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/670,861

(22) Filed: Oct. 31, 2019

(65) Prior Publication Data

US 2020/0068307 A1 Feb. 27, 2020

Related U.S. Application Data

(63) Continuation of application No. 15/898,383, filed on Feb. 16, 2018, now Pat. No. 10,484,792.

(51) Int. Cl.
*H04R 5/033* (2006.01)
*G10K 11/178* (2006.01)
(Continued)

(52) U.S. Cl.
CPC ..... *H04R 5/033* (2013.01); *G10K 11/178* (2013.01); *G10K 11/17883* (2018.01);
(Continued)

(58) Field of Classification Search
None
See application file for complete search history.

(56) References Cited

U.S. PATENT DOCUMENTS 5,280,543 A 1/1994 Yokoyama et al.
6,078,672 A 6/2000 Saunders et al.
(Continued)

FOREIGN PATENT DOCUMENTS

CN 101184345 A 5/2008
EP 1841278 A1 10/2007
WO 2017/049241 A1 3/2017

OTHER PUBLICATIONS

European Extended Search Report and Opinion for European Application No. 19157211.4, dated Apr. 5, 2019, 9 pages.
(Continued)

*Primary Examiner* — Antim G Shah
(74) *Attorney, Agent, or Firm* — TraskBritt

(57) ABSTRACT

Methods of operating headphones may involve filtering an input signal into a first filtered input signal and a second filtered input signal utilizing a filter. The second filtered input signal may be sent directly to a tactile vibration driver and tactile vibrations may be produced. A fixed, predetermined inverse transfer function may be applied to the first filtered input signal, generating an anti-wave signal. The anti-wave signal may be summed with the first filtered input signal, generating an output signal. Alternatively, a fixed, predetermined transfer function may be applied to the first filtered input signal, generating a modified input signal. The modified input signal may be subtracted from the first filtered input signal, generating an output signal. Audio sound waves may be produced with an acoustic driver responsive to the output signal, reducing effects of incidental acoustic noise generated by the tactile vibration driver.

20 Claims, 6 Drawing Sheets

(51) Int. Cl.
*H04R 1/10* (2006.01)
*H04R 5/04* (2006.01)

(52) U.S. Cl.
CPC ..... *H04R 1/1083* (2013.01); *H04R 5/04* (2013.01); *G10K 2210/1081* (2013.01); *G10K 2210/129* (2013.01); *G10K 2210/3028* (2013.01); *H04R 1/1008* (2013.01); *H04R 2400/03* (2013.01); *H04R 2460/01* (2013.01); *H04R 2460/13* (2013.01)

(56) References Cited

U.S. PATENT DOCUMENTS 6,118,878 A 9/2000 Jones
6,377,145 B1 4/2002 Kumagai
7,103,188 B1 9/2006 Jones
7,110,551 B1 9/2006 Saunders et al.
7,177,433 B2 2/2007 Sibbald
7,489,785 B2 2/2009 Donaldson et al.
8,045,724 B2 10/2011 Sibbald
8,054,992 B2 11/2011 Sapiejewski
8,116,472 B2 2/2012 Mizuno
8,254,592 B2 8/2012 Sander et al.
8,401,205 B2 3/2013 Itabashi et al.
8,416,959 B2 4/2013 Lott et al.
8,553,900 B2 10/2013 Cheah et al.
8,965,028 B2 2/2015 Oishi et al.
9,648,412 B2 5/2017 Timothy et al.
10,484,792 B2 * 11/2019 Sheffield ..... G10K 11/17883
2008/0112581 A1 5/2008 Kim et al.
2008/0240484 A1 10/2008 Tanghe et al.
2010/0005953 A1 * 1/2010 Kemmochi ..... H04R 5/04 84/633
2015/0170633 A1 6/2015 Nakagawa et al.
2015/0189441 A1 7/2015 Oishi et al.
2016/0118035 A1 4/2016 Hyde et al.
2016/0133244 A1 5/2016 Tzirkel-Hancock et al.
2016/0192060 A1 6/2016 Noertker et al.
2016/0267898 A1 9/2016 Terlizzi
2017/0148428 A1 5/2017 Thuy et al.
2017/0180863 A1 * 6/2017 Biggs ..... H04R 1/1075
2017/0208380 A1 7/2017 Slater et al.
2019/0174217 A1 6/2019 Sheffield
2019/0189106 A1 6/2019 Hull et al.

OTHER PUBLICATIONS

Löllmann et al., "Generalized Filter-Bank Equalizer for Noise Reduction with Reduced Signal Delay", Sep. 8, 2005, Proceedings of European Conference on Speech Communication and Technology (Interspeech), Lisbon, Portugal, pp. 2105-2108, XP055091633.
European Search and Opinion for European Application No. 18206387.5, dated May 23, 2019, 5 pages.
European Examination Report from European Application No. 19157211.4, dated Apr. 28, 2021, 9 pages.

* cited by examiner

METHODS OF USING HEADPHONES WITH NOISE CANCELLATION OF ACOUSTIC NOISE FROM TACTILE VIBRATION DRIVER

CROSS-REFERENCE TO RELATED APPLICATION

This application is a continuation of U.S. patent application Ser. No. 15/898,383, filed Feb. 16, 2018, now U.S. Pat. No. 10,484,792, issued Nov. 19, 2019, the disclosure of which is hereby incorporated herein in its entirety by this reference.

TECHNICAL FIELD

The present disclosure relates to a headphone that includes a tactile vibration driver, and to related methods of operating such a headphone to cancel acoustic noise associated with the tactile vibration driver.

BACKGROUND

Headphones receive an audio signal from a source media device, such as a phone, computer, tablet computer, television, gaming console, etc., and produce an audible acoustic sound output to the ear(s) of the user. Wireless and wired headphones are commercially available in over-ear, on-ear, and in-ear configurations. The audio signal for wireless headphones is commonly provided to the headphones from the source media device using BLUETOOTH® technology, but other wireless communication protocols may also be employed, such as WIFI or infra-red (IR) technology, for example. The audio signal for wired headphones may be provided to the headphones from the source media device through a removable audio cable connected therebetween. Conventional active noise cancellation systems within headphones rely on a microphone that captures environmental noise, and which inverts the captured environmental noise to generate an anti-wave signal that cancels out the environmental noise.

BRIEF SUMMARY

In some embodiments, the present disclosure includes a headphone having a housing, an acoustic driver within the housing and configured to generate acoustic sound waves responsive to an input signal, a tactile vibration driver within the housing and configured to generate tactile vibration sufficient to be felt by a user responsive to the input signal, and a noise cancellation unit coupled with the acoustic driver. The noise cancellation unit is configured to generate an adjustment signal according to a transfer function associated with the tactile vibration driver generating acoustic noise incidental to the tactile vibrations, and adjust the input signal responsive to the adjustment signal to transmit an output signal for reproduction by the acoustic driver.

In yet further embodiments, the present disclosure includes a method of operating a headphone. In accordance with such embodiments, audio sound waves are produced with an acoustic driver responsive to an input signal. Tactile vibrations are produced with a tactile vibration driver to be felt by a user responsive to the input signal. Incidental acoustic noise from the tactile vibration driver is reduced using a noise cancellation unit that generates an anti-wave signal to sum with the input signal. The noise cancellation unit has a predetermined inverse transfer function based on a transfer function based, at least in part, on operation of the tactile vibration driver.

In yet further embodiments, the present disclosure includes a method of making one or more headphones. In accordance with such embodiments, a transfer function of a first tactile vibration driver is determined by measuring acoustic noise generated by the first tactile vibration driver within an enclosure of a first headphone housing the first tactile vibration driver. One or more headphones are then produced that include an acoustic driver, a tactile vibration driver, and an enclosure. Each of the one or more headphones may have the same transfer function the first tactile vibration driver and the first headphone. Each headphone may also include a noise cancellation unit operably coupled with its acoustic driver. The noise cancellation unit may be configured to generate an anti-wave signal by applying an inverse transfer function responsive to the input signal. The inverse transfer function is at least partially based on an inverse of the determined transfer function. The noise cancellation unit is further configured to sum the anti-wave signal with the input signal to transmit an output signal for reproduction by the acoustic driver.

DETAILED DESCRIPTION

Figure 1:
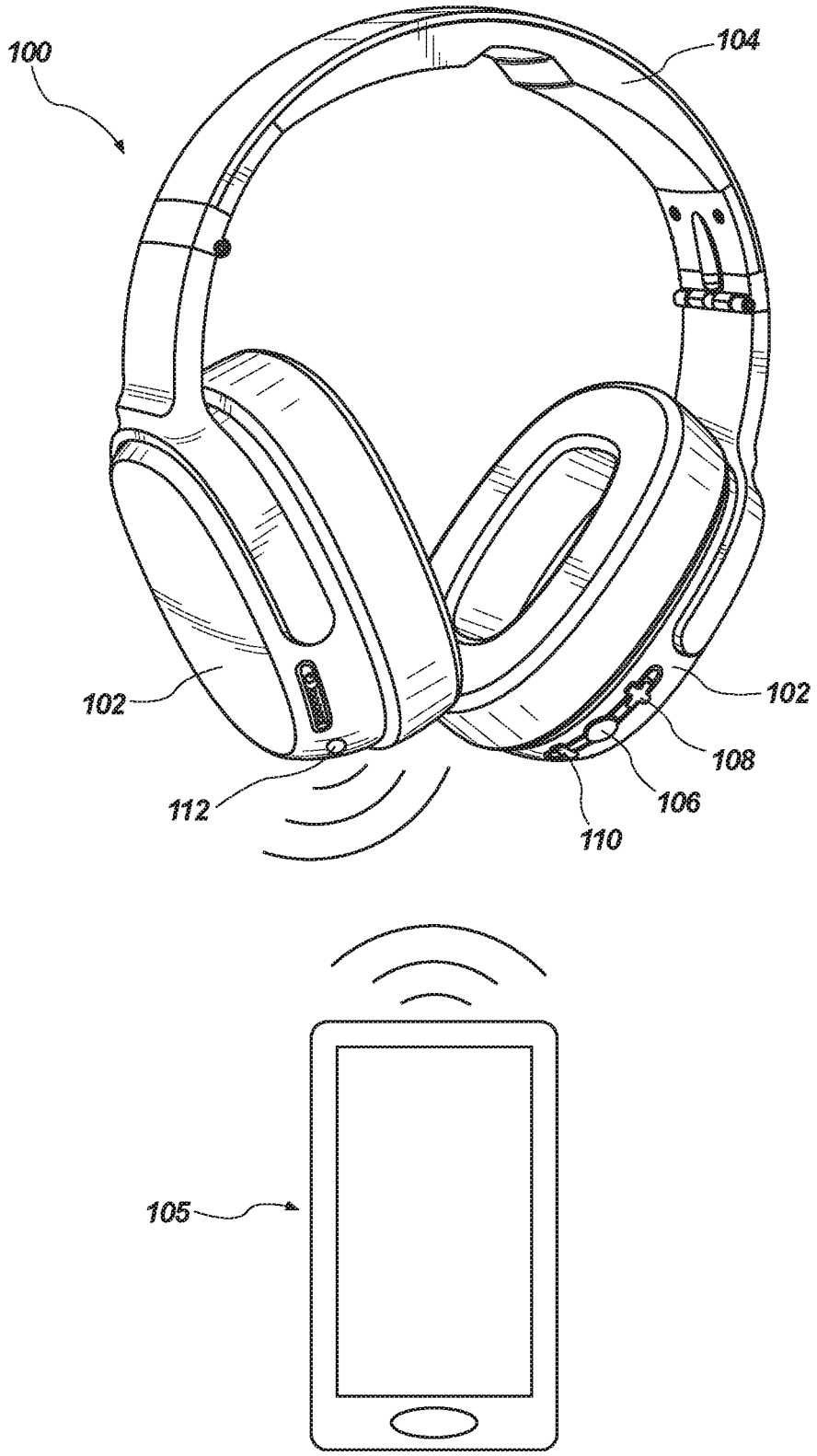
FIG. 1 illustrates an example of an embodiment of a headphone according to the present disclosure, an associated source media device wirelessly transmitting an audio signal to the headphone.

In the following detailed description, reference is made to the accompanying drawings which form a part hereof, and in which is shown by way of illustration, specific embodiments in which the invention may be practiced. These embodiments are described in sufficient detail to enable those of ordinary skill in the art to practice the invention. It should be understood, however, that the detailed description and the specific examples, while indicating examples of embodiments of the invention, are given by way of illustration only and not by way of limitation. From this disclosure, various substitutions, modifications, additions rearrangements, or combinations thereof within the scope of the disclosure may be made and will become apparent to those of ordinary skill in the art.

In addition, some of the drawings may be simplified for clarity. Thus, the drawings may not depict all of the components of a headphone according to the present disclosure. In addition, like reference numerals may be used to denote like features throughout the specification and figures.

As used herein, the terms "operably couple," "operably coupled," "operably coupling," and other forms of the term "operably couple" refer to both wireless (e.g., BLUETOOTH®, WiFi, ZIGBEE®, etc.) and wired (e.g., electrical, optical, etc.) connections. "Operably couple," and its other forms may also refer to both direct (i.e., nothing coupled in between operably coupled components) and indirect (i.e., other components coupled in between operably coupled components) connections.

An "acoustic driver" is defined herein as transducer configured for the primary purpose of generating sound waves from an electrical signal, such as for the reproduction of speech, music, or other audible sound. An acoustic driver may also be referred to as a "speaker." Although a diaphragm of an acoustic driver may vibrate to produce sound waves, such vibrations are typically not felt in any significant manner by the user during normal operation of a headphone.

A "tactile vibration driver" is defined herein as a transducer configured for the primary purpose of generating tactile vibrations that are to be felt by a user. A tactile vibration driver may also produce some incidental, audible acoustic waves that, for purposes of this disclosure, are considered to be "acoustic noise."

A "bass frequency" is a relatively low audible frequency generally considered to be within the range extending from approximately 16 Hz to approximately 512 Hz. For purposes of this disclosure, a "low bass frequency" refers to bass frequencies that may be felt as well as heard. Such low bass frequencies may be within the range extending from approximately 16 Hz to approximately 200 Hz.

FIG. 1 illustrates an embodiment of a headphone 100 according to the present disclosure. The headphone 100 may be configured to be operated in a wireless mode with respect to a source media device 105. In the example embodiment illustrated in FIG. 1, the headphone 100 is an over-the-ear headphone, although the headphone 100 may be an in-ear headphone or an on-ear headphone in accordance with additional embodiments of the present disclosure. The headphone 100 includes two ear-cup assemblies 102, which are connected to one another by a headband 104. An acoustic driver as well as a tactile vibration driver are carried within each ear-cup assembly 102. In embodiments of the present disclosure, the headphone 100 is configured to perform noise cancellation to reduce the effects of acoustic noise generated by the tactile vibration driver, as will be discussed further below with respect to FIGS. 3-4.

The headphone 100 may be characterized as a wireless headphone, and includes a power source (e.g., a battery) because the power for driving the acoustic drivers and tactile vibration driver is not provided by the source media device 105 providing the audio signal in the wireless embodiment of FIG. 1. The headphone 100 may be operably coupled (e.g., "paired") with a source media device 105, such as a smartphone, using BLUETOOTH® technology, but other wireless communication protocols may also be employed, such as WIFI or infra-red (IR) technology, for example.

The headphone 100 may also include at least one control input for controlling operation of the headphone 100. As a non-limiting example, the at least one control input may include a power button 106 for powering the headphone 100 on and/or off when the headphone 100. The power button 106 may also be used to initiate a pairing sequence with a source media device 105 by, for example, pressing and holding the power button 106. When the headphone 100 is powered on and playing an audio signal provided by an associated source media device 105, sequential pressing of the power button 106 may cause the source media device 105 to sequentially pause and then commence play of the audio signal. In the event the source media device 105 is a smartphone and the smartphone is receiving an incoming telephone call, pressing the power button 106 may cause the smartphone to answer the call, after which pressing the power button 106 may cause the smartphone to drop the call.

The at least one control input may also include an up/forward button 108, and a down/backward button 110. In the wireless mode of operation, pressing the up/forward button 108 may increase the volume of the headphone 100, while pressing the down/backward button 110 may decrease the volume of the headphone 100. Holding the up/forward button 108 while the headphone 100 is playing an audio signal may skip forward media files in a list of media files of an associated source media device 105, while holding the down/backward button 110 while the headphone 100 is playing an audio signal may skip forward media files in a list of media files of an associated source media device 105 in the wireless mode of operation.

The headphone 100 further includes a microphone 112. The microphone 112 may be used to generate an audio signal corresponding to the voice of the user for purposes of conducting telephone calls or conveying voice commands to the associated source media device 105. In the wireless mode of operation, the microphone 112 may receive power from the power source carried by the headphone 100, and the audio signal generated by the headphone may be conveyed to a microprocessor within the headphone 100, and then wirelessly to the source media device 105.

Figure 2:
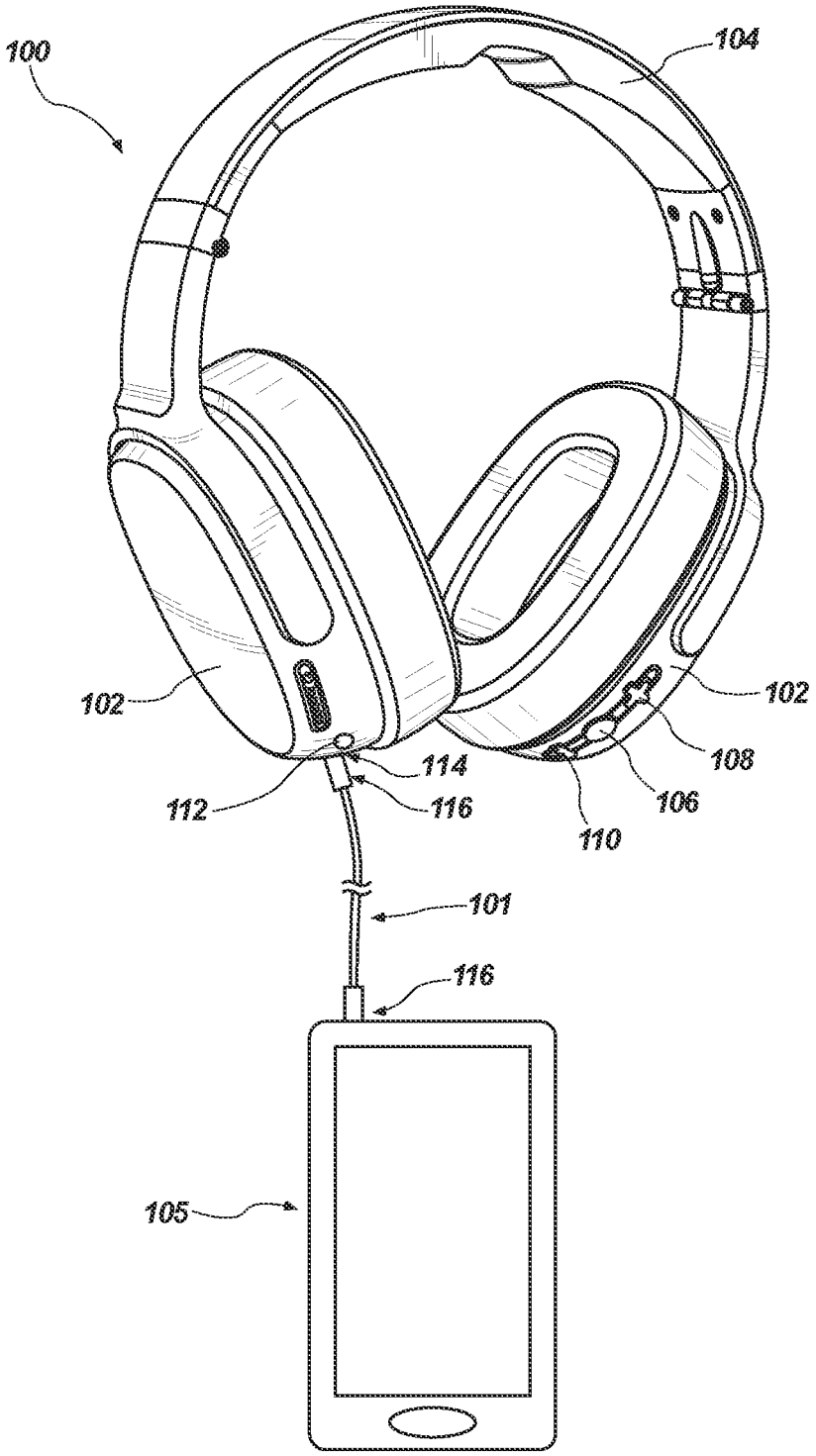
FIG. 2 illustrates a source media device transmitting an audio signal to the headphone of FIG. 1 through an audio cable.

FIG. 2 illustrates an embodiment of a headphone 100 according to another embodiment of the present disclosure. The headphone 100 may be configured to be operated in a wired mode with respect to the source media device 105. In other words, the headphone 100 may be used in a wired configuration by plugging one of the jacks 116 of the audio cable 101 into the jack 114 of the headphone 100, and the other jack 116 of the audio cable 101 into the source media device 105. The headphone 100 may be configured such that operation of the at least one control input (e.g., the power button 106, the up/forward button 108, and/or the down/backward button 110), and/or the microphone 112 is altered upon insertion of the jack 116 of the audio cable 101 into the jack 114 of the headphone 100. In the wired mode of operation shown in FIG. 2, the at least one control input (e.g., the power button 106, the up/forward button 108, and/or the down/backward button 110) may be used to provide an input signal for controlling operation of the associated source media device 105 through the audio cable 101.

Although a headphone is described as being either a wireless headphone (FIG. 1) or a wired headphone (FIG. 2), embodiments of the disclosure also include headphones that can be operated in either wireless mode or a wired mode as desired. An example of such a headphone is described in U.S. patent Ser. No. 15/832,527, entitled "Headphone with Adaptive Controls," filed Dec. 5, 2017, the disclosure of which is incorporated herein in its entirety by this reference.

Figure 3:
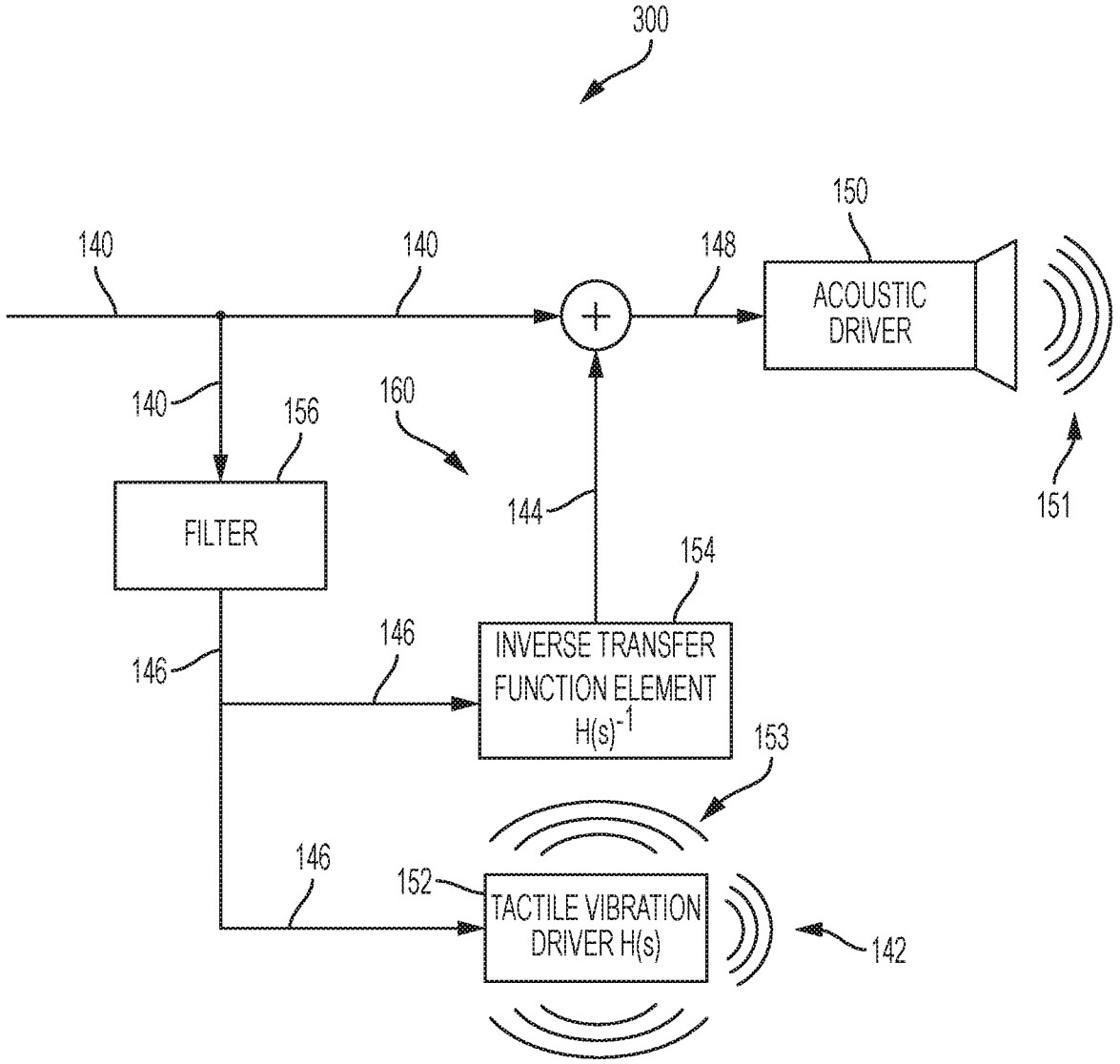
FIG. 3 is a circuit diagram of a portion of an embodiment of an electrical circuit that may be employed in the headphone of FIGS. 1-2 in accordance with the present disclosure.

FIG. 3 is a simplified schematic block diagram of a portion an audio/tactile unit 300 that may be employed in the headphone 100 of FIG. 1 or FIG. 2 in accordance with the present disclosure. The headphone may include an audio/ tactile unit 300 as described below in each ear cup of the headphone. As discussed above, the headphone 100 may include an acoustic driver 150 and a tactile vibration driver 152. The audio/tactile unit 300 may provide a noise cancellation unit (also referred to as "noise reducer" or "noise canceller" or variations thereof) in a noise cancellation path 160 including control logic configured to operate the headphone to receive an input signal 140 and reduce the effects of acoustic noise 142 generated by the tactile vibration driver 152 of the headphone 100. In particular, the noise cancellation path 160 may include the inverse transfer function element(s) 154 configured to generate and add an anti-wave signal 144 to the input signal 140 for reproduction by the acoustic driver 150. The input signal 140 may be generated by the source media device 105 (FIGS. 1-2) and/or an internal processor of the headphone 100 responsive to the source media device 105.

The acoustic driver 150 (e.g., speaker) may be configured to convert an output signal 148 into audible sound waves 151 across the frequency range of the input signal 140. The tactile vibration driver 152 is a separate driver from the acoustic driver 150 that is configured to generate tactile vibrations 153 that are felt by the user. The tactile vibrations 153 may be generated at particular frequencies of the source media to enhance the user experience. For example, the source media may include music that is enhanced by vibrating with the bass frequencies. In another example, the source media (e.g., movies, gaming, etc.) may include effects such as explosions that may be enhanced by vibrations being generated that are felt by the user. Specific examples of configurations of tactile vibration drivers are described in U.S. Pat. No. 9,648,412 to Timothy et al., which issued May 9, 2017, and in U.S. Pat. No. 8,965,028 to Oishi et al., which issued Feb. 24, 2015, the disclosure of each of which is incorporated in its entirety by this reference. In addition, headphone devices incorporating such acoustic drivers are commercially available from Skullcandy, Inc., of Park City, Utah, under the trademark SKULLCRUSHERS®.

With continued reference to FIG. 3, the input signal 140 may be split and sent on a first channel toward the acoustic driver 150, and on a second channel toward the tactile vibration driver 152. On the second channel, the input signal 140 may be passed through a filter 156. The filter 156 may be a low pass filter or a band pass filter depending on the desired frequency range for the tactile vibration driver 152. For example, many tactile vibration drivers tend to be configured with a resonant frequency within the bass frequency range (e.g., 16 Hz to 512 Hz). For example, the filter 156 may be configured as a band pass filter configured to pass low bass frequencies in the band range extending from about 16 Hz to about 200 Hz, while attenuating frequencies outside of that frequency range. Other filter ranges (e.g., 20 Hz to 150 Hz) are also contemplated as desired for the desired effect, which may also be influenced by the resonant frequency of the source media and/or the resonant frequency of the tactile vibration driver 152. In some embodiments, a gain stage (not shown) may be incorporated with the filter 156 or a separate block before or after the filter 156.

After passing through the filter 156, the filtered input signal 146 may be split and sent both to the inverse transfer function element(s) 154 and to the tactile vibration driver 152, as shown in FIG. 3. The tactile vibration driver 152 generates the intended and desirable tactile vibrations 153, but may also generate some unintended and undesirable acoustic noise 142. The inverse transfer function element(s) 154 are configured to apply a predetermined transfer function $H(s)^{-1}$ to the filtered input signal 146 to generate an anti-wave signal 144. The anti-wave signal 144 is summed (i.e., combined) with the input signal 140 to generate the output signal 148, which is sent to the acoustic driver 150 and generates the intended audible sound waves 151. The anti-wave signal 144 forms a portion of the output signal 148 that causes destructive interference with acoustic noise 142 from the tactile vibrations. As a result, the amount of acoustic noise 142 generated by the tactile vibration driver 152 that is ultimately heard by the user may be reduced, or even eliminated in some embodiments.

The inverse transfer function $H(s)^{-1}$ may be based, at least in part, on an inverse of a determined transfer function H(s) of the tactile vibration driver 152. For ease of description, the term "the transfer function" is represented by H(s), whereas the term "inverse transfer function" is represented as $H(s)^{-1}$. In some embodiments, the inverse transfer function $H(s)^{-1}$ may not be a perfect inverse of the determined transfer function H(s) of the tactile vibration driver 152 as discussed below.

The transfer function H(s) may be determined by comparing the filtered input signal 146 to the acoustic noise 142. In particular, a microphone may be used to generate an electrical signal from the acoustic noise 142 (the microphone signal), and the microphone signal may be compared to the filtered input signal 146. As known to those in the art, the transfer function H(s) is the function that, when applied to the filtered input signal 146, will result in the signal corresponding to the acoustic noise 142 (represented by the microphone signal). The transfer function H(s) may be based, at least in part, on the configuration of the tactile vibration driver 152 (e.g., materials, configuration, dimensions, etc.). In some embodiments, the transfer function H(s) may be additionally based on the configuration of the enclosure of the headphone 100 (e.g., shape, material, cavity, etc.) housing the tactile vibration driver 152, as well as the position and/or orientation of the tactile vibration driver 152 and other components within the headphone 100. The transfer function H(s) may include phase, frequency, amplitude information for the generated acoustic noise 142 related to an input signal. Such acoustic tests may be performed for the tactile vibration driver 152 located within the enclosure of the headphone in some embodiments to account for influences of other components of the headphone 100. The transfer function H(s) may be determined once by the headphone manufacturer for any particular model of headphone. From that determined transfer function H(s), the inverse transfer function $H(s)^{-1}$ may be determined, and used in all headphones of the same particular model.

In some embodiments, because the anti-wave signal 144 will also be summed and processed by the acoustic driver 150, the inverse transfer function $H(s)^{-1}$ may also be adjusted to not be a perfect inverse of the determined transfer function H(s) for acoustic noise 142 from the tactile vibration driver 152 and other enclosure elements. For example, the inverse transfer function $H(s)^{-1}$ may also be adjusted to account for the transfer function of the acoustic path through the acoustic driver 150 as doing so may compensate for distortion of the anti-wave signal 144 passing through the acoustic driver 150.

The control logic of the inverse transfer function element(s) 154 may be implemented using hardware components, software, or a combination thereof. If implemented in hardware, the specific configuration of hardware components may be arranged to perform the desired inverse transfer function $H(s)^{-1}$ For example, the inverse transfer function element(s) 154 and/or the filter 156 of the audio/tactile unit 300 may be implemented with analog circuit components (e.g., op-amps, resistors, capacitors, etc.) arranged and coupled to achieve the desired filter range of the filter 156 and inverse transfer function $H(s)^{-1}$ for the inverse transfer function element(s) 154. If implemented in software, the instructions may be written and stored in a non-transitory storage medium for execution by a digital signal processor to perform the desired inverse transfer function $H(s)^{-1}$ for the inverse transfer function element(s) 154. The filter 156 may also be implemented in either hardware or software, and which may also be integrated with the design of the inverse transfer function element(s) 154 in some embodiments.

In operation, audible sound waves 151 are produced with the acoustic driver 150 responsive to the output signal 148. Tactile vibrations 153 to be felt by a user are also produced by the tactile vibration driver 152 responsive to the filtered input signal 146. The filter 156 may filter the input signal 140 according to a desired frequency range to generate the filtered input signal 146 that is sent to the inverse transfer function elements 154 and the tactile vibration driver 152, as previously discussed. Some acoustic noise 142 may also be generated by the tactile vibration driver 152, as previously discussed.

The audible sound waves 151 generated by the acoustic driver 150, however, include some "anti-noise" sound waves that interfere with and cancel the acoustic noise 142, so as to reduce or eliminate the amount of acoustic noise 142 that is actually heard by the user. The anti-noise sound waves are generated by the tactile vibration driver 152 in response to the portion of the output signal 148 corresponding to the anti-wave signal 144 generated by the inverse transfer function elements 154. The inverse transfer function elements 154 applies the predetermined inverse transfer function $H(s)^{-1}$ based, at least in part, on the transfer function H(s) attributed to the tactile vibration driver 152 and other elements of the headphone associated with the tactile vibration driver 152. This noise cancellation is performed without the use of a microphone capturing environmental noise for the noise cancellation.

Figure 4:
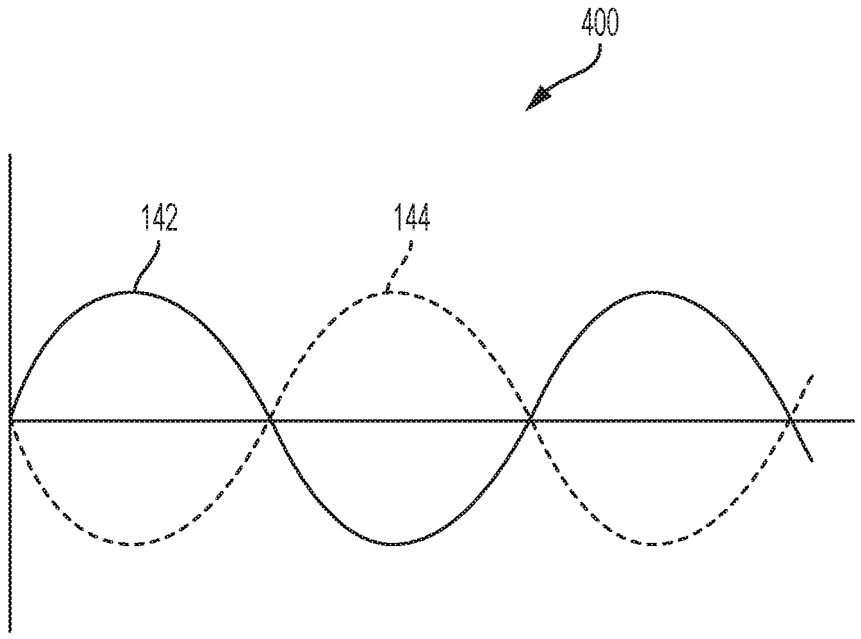
FIG. 4 is a plot showing an example waveform of acoustic noise that may be generated by the tactile vibration driver, and an anti-wave signal that may be generated by the noise cancellation unit to cancel the acoustic noise.

FIG. 4 is a simplified plot 400 of the acoustic noise 142 generated by the tactile vibration driver 152 (FIG. 3) and the anti-wave signal 144 generated by the inverse transfer function element(s) 154. As discussed above, the anti-wave signal 144 is generated by applying the inverse transfer function $H(s)^{-1}$ to the filtered input signal to generate substantially the inverse of the acoustic noise 142 generated by the tactile vibration driver 152. In some embodiments, the inverse transfer function $H(s)^{-1}$ and the transfer function H(s) of the tactile vibration driver 152 may not be perfect inverses of each other due to effects on the acoustic noise by the headphone environment and/or the anti-wave signal 144 passing through the summation and acoustic driver 150. Aa result, when the anti-wave signal 144 added to the input signal 140, the acoustic driver 150 generates audible sound waves 151 that include the reproduced input signal 140 as well as the anti-noise sound waves resulting from the anti-wave signal 144. The anti-noise sound waves reduces (e.g., cancel) the effects of the acoustic noise 142 so that the audible sound waves of the input signal 140 for the source media may be more clear, while the tactile vibration driver 152 still generates the tactile vibrations felt by the user but does not contribute audible sound to the experience of the user.

Figure 5:
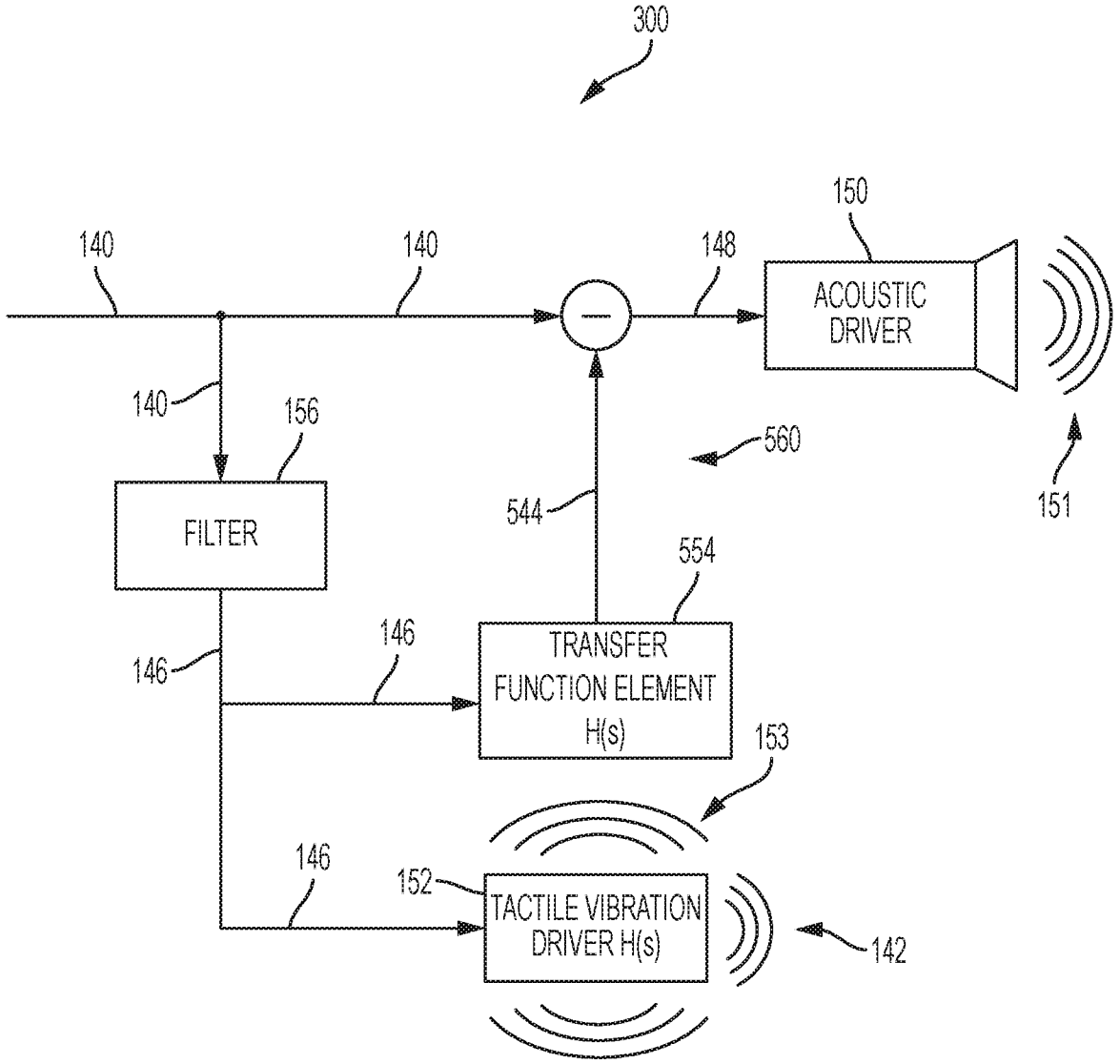
FIG. 5 is a simplified schematic block diagram of a portion an audio/tactile unit 300 that may be employed in the headphone of FIG. 1 or FIG. 2 in accordance with the present disclosure.

FIG. 5 is a simplified schematic block diagram of a portion an audio/tactile unit 300 that may be employed in the headphone 100 of FIG. 1 or FIG. 2 in accordance with the present disclosure. The headphone may include an audio/tactile unit 300 as described below in each ear cup of the headphone. The audio/tactile unit 300 may include an acoustic driver 150, a filter 156, and tactile vibration driver 152 with exhibiting the transfer function H(s) configured in a similar manner as with FIG. 3. However, rather than the noise cancellation path including the inverse transfer function $H(s)^{-1}$ and summing the anti-wave signal 144 with the input signal 140 (as in FIG. 3), the noise cancellation path 560 of FIG. 5 includes transfer function elements 554 configured to apply the transfer function H(s) to the filtered input signal 146 (as opposed to its inverse) and then subtracting the resulting anti-wave signal 144 from the input signal 140 prior to being received by the acoustic driver 150 to generate the output signal 148 converted to audible sound. As a result, the acoustics generated by the tactile vibration driver 152 may be accounted for in the main acoustic path by removing the right portion of the signal from the acoustic driver 150 so that net acoustics generated by both drivers 150, 152 is as if only the acoustic driver 150 was present in the headphone 100. The transfer function H(s) is based, at least in part, on how much acoustics is generated by the tactile vibration driver, and the phase may be matched to the electrical input signal to the acoustic driver 150. The "cancellation" effect may be achieved electrically before the acoustic driver as opposed to through destructive interferences. Because of this subtraction, the acoustic driver 150 may reproduce less bass response during operation.

In another embodiment, the inverse transfer function $H(s)^{-1}$ may be applied in the path that is received by the tactile vibration driver 152. For example, the inverse transfer function $H(s)^{-1}$ may be applied to the filtered input signal 146 or the input signal 140 prior to driving the tactile vibration driver 152 such that the acoustic effects are reduced; however, doing so may reduce energy to cause the tactile vibration driver 152 to vibrate less and achieve a lower vibration effect. As such a situation may be less desirable, pulling energy from the acoustic driver 150 may be a preferable solution.

Figure 6:
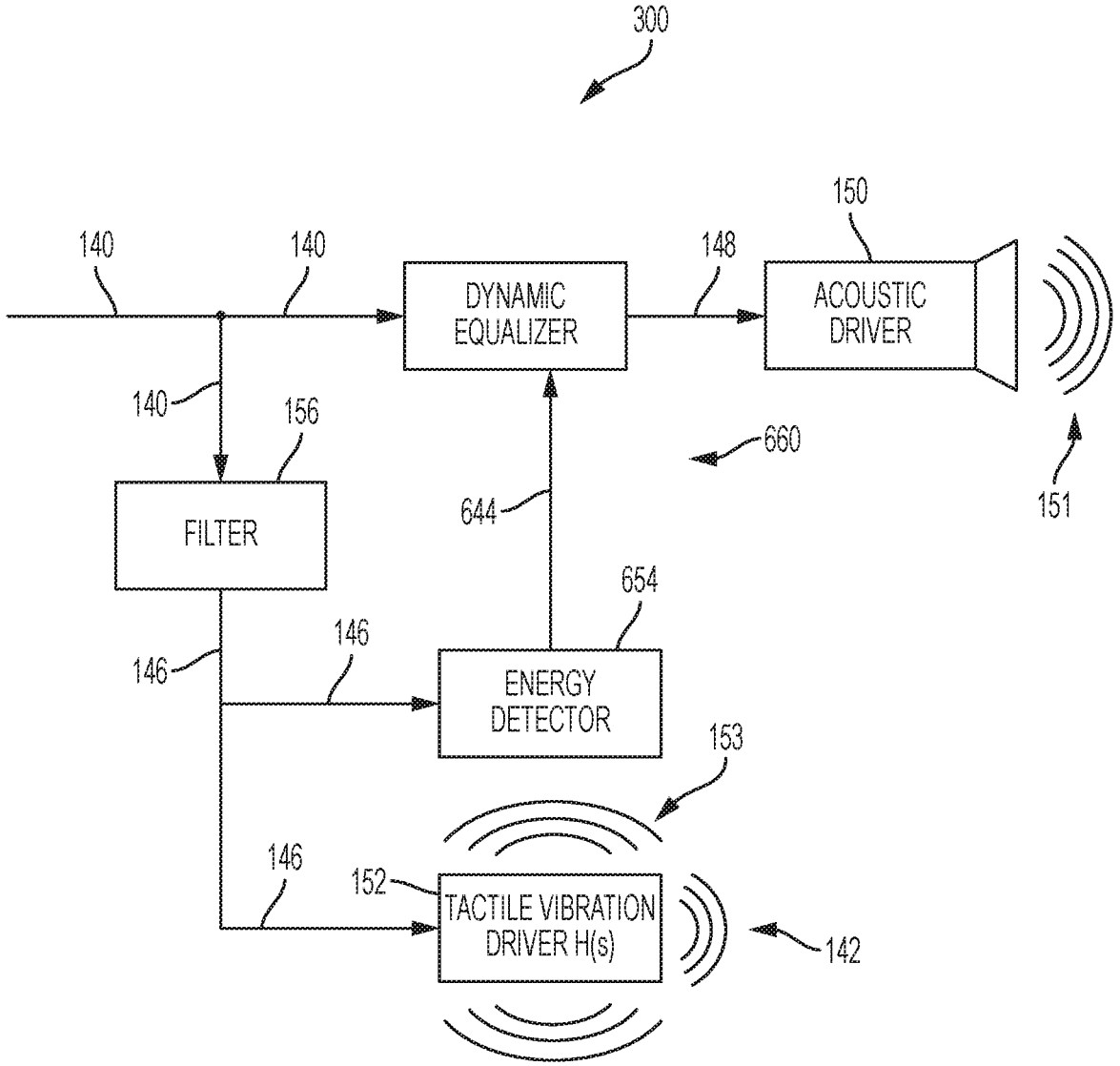
FIG. 6 is a simplified schematic block diagram of a portion an audio/tactile unit 300 that may be employed in the headphone of FIG. 1 or FIG. 2 in accordance with the present disclosure.

FIG. 6 is a simplified schematic block diagram of a portion an audio/tactile unit 300 that may be employed in the headphone 100 of FIG. 1 or FIG. 2 in accordance with the present disclosure. The headphone may include an audio/tactile unit 300 as described below in each ear cup of the headphone. The audio/tactile unit 300 may include an acoustic driver 150, a filter 156, and tactile vibration driver 152 with exhibiting the transfer function H(s) configured in a similar manner as with FIG. 3. However, rather than the noise cancellation path 660 including the inverse transfer function $H(s)^{-1}$ and summing the anti-wave signal 144 with the input signal 140 (as in FIG. 3), the noise cancellation path 660 of FIG. 6 includes an energy detector 654 and a dynamic equalizer 644.

The dynamic equalizer 644 may be configured to adjust (e.g., subtract) the needed energy for the input signal 140 for each frequency band to adjust the amount of acoustic energy is output by the acoustic driver 150 relative to the amount of acoustic energy output by the tactile vibration driver 152. The acoustic energy of the tactile vibration driver 152 may be estimated with the transfer function H(s) which then may be applied to a Fast Fourier Tranform (FFT) to split up the filtered input signal 146 into frequency bands (e.g., band1=10-15 Hz, b2=15-20 Hz, b3=20-25 Hz, etc.). The energy determined to be in each frequency band may then be subtracted from the energy level by the dynamic equalizer 644 for each band of the input signal prior to being received by the acoustic driver 150. The energy detector 654 and the dynamic equalizer 644 may be implemented with a DSP.

Additional non-limiting example embodiments of the present disclosure are set forth below:

Embodiment 1: a headphone comprising a housing, an acoustic driver within the housing and configured to generate acoustic sound waves responsive to an input signal, a tactile vibration driver within the housing and configured to generate tactile vibration sufficient to be felt by a user responsive to the input signal, and a noise cancellation unit coupled with the acoustic driver, the noise cancellation unit configured to generate an adjustment signal according to a transfer function associated with the tactile vibration driver generating acoustic noise incidental to the tactile vibrations, and adjust the input signal responsive to the adjustment signal to transmit an output signal for reproduction by the acoustic driver.

Embodiment 2: the headphone of Embodiment 1, wherein the predetermined transfer function is also associated with the tactile vibration driver when located within the housing.

Embodiment 3: the headphone of Embodiment 1 or Embodiment 2, wherein the noise cancellation unit is configured to: generate the adjustment signal by applying an inverse transfer function of the transfer function to generate an anti-wave signal; and adjust the input signal by summing the input signal and the anti-wave signal.

Embodiment 4: the headphone of Embodiment 3, wherein the noise cancellation unit includes analog components configured to implement the inverse transfer function.

Embodiment 5: the headphone of Embodiment 3, wherein the noise cancellation unit includes a digital signal processor configured to implement the inverse transfer function by executing instructions stored in a memory device.

Embodiment 6: the headphone of any one of Embodiments 1 through 5, wherein the noise cancellation unit is configured to generate the adjustment signal without the use of a microphone.

Embodiment 7: the headphone of any one of Embodiments 1 through 6, further comprising a filter operably coupled with the tactile vibration driver and the noise cancellation unit.

Embodiment 8: the headphone of Embodiment 7, wherein the filter includes a band pass filter configured to filter the input signal to pass bass frequencies to the tactile vibration driver and the noise cancellation unit.

Embodiment 9: the headphone of Embodiment 8, wherein the bass frequencies are set at low bass frequencies.

Embodiment 10: the headphone of any one of Embodiments 1 through 9, wherein the noise cancellation unit is configured to: generate the adjustment signal by applying the transfer function to generate an anti-wave signal; and adjust the input signal by subtracting the input signal and the anti-wave signal.

Embodiment 11: the headphone of Embodiment 1 or Embodiment 2, wherein the noise cancellation unit includes an energy detector coupled with a dynamic equalizer configured to adjust the input signal utilizing the dynamic equalizer to subtract signals at frequencies of the adjustment signal based on the transfer function associated with the tactile vibration driver.

Embodiment 12: the headphone of Embodiment 7, wherein the filter includes a low pass filter.

Embodiment 13: the headphone of any one of Embodiments 1 through 12, wherein the headphone is an over-ear or on-ear headphone or an in-ear headphone.

Embodiment 14: the headphone of any one of Embodiments 1 through 13, wherein the headphone is configured as at least one of a wired headphone or a wireless headphone.

Embodiment 15: the headphone of Embodiment 8, wherein the bass frequencies are set for a frequency range of 16 Hz to 512 Hz.

Embodiment 16: the headphone of Embodiment 8, wherein the bass frequencies are set for a frequency range of 16 Hz to 200 Hz.

Embodiment 17: the headphone of Embodiment 8, wherein the bass frequencies are set for a frequency range of 20 Hz to 150 Hz.

Embodiment 18: a method of operating a headphone, comprising: producing audio sound waves with an acoustic driver responsive to an input signal; producing tactile vibrations with a tactile vibration driver to be felt by a user responsive to the input signal; and reducing effects of incidental acoustic noise generated by the tactile vibration driver responsive to a noise cancellation unit generating an adjustment signal to apply to the input signal, the noise cancellation unit having its own transfer function based at least partially on a transfer function associated with operation of the tactile vibration driver.

Embodiment 19: the method of Embodiment 18, wherein the transfer function associated with operation of the tactile vibration driver is further based, at least in part, on an enclosure of the headphone housing the tactile vibration driver.

Embodiment 20: the method of Embodiment 18 or 19, further comprising filtering the input signal to apply a filtered input signal to drive the tactile vibration driver, wherein reducing incidental acoustic noise from the tactile vibration driver includes: generating an anti-wave signal as the adjustment signal by applying an inverse transfer function as the transfer function of the noise cancellation unit to the filtered input signal; and summing the anti-wave signal from and the input signal prior to producing the audio sound waves.

Embodiment 21: the method of Embodiment 18 or 19, further comprising filtering the input signal to apply a filtered input signal to drive the tactile vibration driver, wherein reducing incidental acoustic noise from the tactile vibration driver includes: generating an anti-wave signal as the adjustment signal by applying an inverse transfer function as the transfer function of the noise cancellation unit to the filtered input signal; and summing the anti-wave signal from and the input signal prior to producing the audio sound waves.

Embodiment 22: the method of any one of Embodiments 18 through 21, wherein generating the adjustment signal is performed without the use of a microphone capturing environmental noise.

Embodiment 23: A method of making one or more headphones, the method comprising: determining a transfer function of a first tactile vibration driver by measuring acoustic noise generated by the first tactile vibration driver within an enclosure of a first headphone housing the first tactile vibration driver; and producing one or more headphones including: an acoustic driver, a tactile vibration driver, and enclosure having the same transfer function as the first tactile vibration driver and the first headphone; and a noise cancellation unit operably coupled with the acoustic driver, the noise cancellation unit configured to generate an adjustment signal by passing the input signal through transfer function elements configured based, at least in part, on the determined transfer function, and transmit an output signal for reproduction by the acoustic driver responsive to adjusting the input signal with the adjustment signal.

What is claimed is:

1. A method of operating a headphone, the method comprising:

filtering an input signal into a first filtered input signal and a second filtered input signal utilizing a filter;

sending the second filtered input signal directly to a tactile vibration driver and producing tactile vibrations with the tactile vibration driver to be felt by a user responsive to the second filtered input signal;

applying a fixed, predetermined inverse transfer function to the first filtered input signal, generating an anti-wave signal;

summing the anti-wave signal with the first filtered input signal, generating an output signal; and producing audio sound waves with an acoustic driver responsive to the output signal, reducing effects of incidental acoustic noise generated by the tactile vibration driver.

2. The method of claim 1, wherein generating the anti-wave signal is performed without the use of a microphone capturing environmental noise.

3. The method of claim 1, wherein applying the fixed, predetermined inverse transfer function and summing the anti-wave signal with the first filtered input signal comprise applying the fixed, predetermined inverse transfer function and summing the anti-wave signal with the first filtered input signal utilizing analog components.

4. The method of claim 1, wherein applying the fixed, predetermined inverse transfer function and summing the anti-wave signal with the first filtered input signal comprise applying the fixed, predetermined inverse transfer function and summing the anti-wave signal with the first filtered input signal utilizing a digital signal processor executing instructions stored in a nontransitory memory device.

5. The method of claim 1, wherein filtering the input signal utilizing the filter comprises filtering the input signal utilizing a band-pass filter or a low-pass filter configured to pass bass frequencies directly to the tactile vibration driver.

6. The method of claim 1, wherein applying the fixed, predetermined inverse transfer function to the first filtered input signal comprises applying a fixed, predetermined inverse transfer function based, at least in part, on one or more of materials, configuration, dimensions, position, and orientation of the tactile vibration driver, one or more of shape, material, and cavity of an enclosure of the headphone, or both to the first filtered input signal.

7. The method of claim 1, wherein applying the fixed, predetermined inverse transfer function to the first filtered input signal comprises applying a fixed, predetermined inverse transfer function including phase, frequency, and amplitude information for generated acoustic noise to the first filtered input signal.

8. The method of claim 1, wherein applying the fixed, predetermined inverse transfer function to the first filtered input signal comprises applying a fixed, predetermined inverse transfer function accounting for a transfer function of an acoustic path through the acoustic driver to the first filtered input signal.

9. The method of claim 1, wherein producing the audio sound waves with the acoustic driver responsive to the output signal comprises producing audio sound waves with the acoustic driver that include the first filtered input signal as well as anti-noise sound waves resulting from the anti-wave signal.

10. The method of claim 1, wherein reducing the effects of the incidental acoustic noise generated by the tactile vibration driver comprises reducing the effects of the incidental acoustic noise generated by the tactile vibration driver utilizing destructive interference.

11. The method of claim 1, further comprising wirelessly connecting the headphone to a source media device.

12. The method of claim 1, further comprising placing the headphone over a user's ears.

13. A method of operating a headphone, the method comprising:

filtering an input signal into a first filtered input signal and a second filtered input signal utilizing a filter;

sending the second filtered input signal directly to a tactile vibration driver and producing tactile vibrations with the tactile vibration driver to be felt by a user responsive to the second filtered input signal;

applying a fixed, predetermined transfer function to the first filtered input signal, generating a modified input signal;

subtracting the modified input signal from the first filtered input signal, generating an output signal; and producing audio sound waves with an acoustic driver responsive to the output signal, reducing effects of incidental acoustic noise generated by the tactile vibration driver.

14. The method of claim 13, wherein generating the modified input signal is performed without the use of a microphone capturing environmental noise.

15. The method of claim 13, wherein the headphone comprises a digital signal processor (DSP) and wherein subtracting the modified input signal from the first filtered input signal comprises subtracting the modified input signal from the first filtered input signal utilizing the DSP.

16. The method of claim 13, wherein the headphone comprises analog components and wherein subtracting the modified input signal from the first filtered input signal comprises subtracting the modified input signal from the first filtered input signal utilizing the analog components.

17. The method of claim 13, wherein filtering the input signal utilizing the filter comprises filtering the input signal utilizing a band-pass filter or a low-pass filter configured to pass bass frequencies directly to the tactile vibration driver.

18. The method of claim 13, wherein applying the fixed, predetermined transfer function to the first filtered input signal comprises applying a fixed, predetermined transfer function based, at least in part, on one or more of materials, configuration, dimensions, position, and orientation of the tactile vibration driver, one or more of shape, material, and cavity of an enclosure of the headphone, or both to the first filtered input signal.

19. The method of claim 13, wherein applying the fixed, predetermined transfer function to the first filtered input signal comprises applying a fixed, predetermined transfer function including phase, frequency, and amplitude information for generated acoustic noise to the first filtered input signal.

20. The method of claim 13, wherein producing the audio sound waves with the acoustic driver responsive to the output signal comprises producing less bass response with the acoustic driver than would be produced if the audio sound waves were produced with the acoustic driver responsive to the input signal.

* * * * *